US006463637B1

(12) United States Patent
Carnahan

(10) Patent No.: US 6,463,637 B1
(45) Date of Patent: Oct. 15, 2002

(54) MOVABLE BELT BUCKLE COVER DEVICE AND PROTECTOR

(75) Inventor: Scott R. Carnahan, Alta Loma, CA (US)

(73) Assignee: Safariland LTD, Inc., Ontario, CA (US)

( * ) Notice: Subject to any disclaimer, the term of this patent is extended or adjusted under 35 U.S.C. 154(b) by 0 days.

(21) Appl. No.: 09/616,756

(22) Filed: Jul. 14, 2000

(51) Int. Cl.[7] ..... A44B 11/26
(52) U.S. Cl. ..... 24/578.15; 24/DIG. 31
(58) Field of Search ..... 24/633, 578.15, 24/579.09, 579.11, 166, 167, 184, DIG. 31

(56) References Cited

U.S. PATENT DOCUMENTS 3,484,908 A * 12/1969 Lamb
4,502,194 A * 3/1985 Morris et al.
4,624,033 A * 11/1986 Orton
4,675,954 A * 6/1987 Gullickson
4,939,824 A * 7/1990 Reed
4,961,251 A * 10/1990 Smith
5,195,666 A * 3/1993 Yamaguchi et al.
5,617,617 A * 4/1997 Gustin
5,884,382 A * 3/1999 Hansen
6,105,219 A * 8/2000 Beadle
6,138,331 A * 10/2000 Powers

FOREIGN PATENT DOCUMENTS

JP 9-285328 * 11/1997
JP 11-18806 * 1/1999

* cited by examiner

*Primary Examiner*—James R. Brittain
(74) *Attorney, Agent, or Firm*—Arthur G. Yeager

(57) ABSTRACT

A protective device for attachment to a waist belt of a law enforcement officer to prevent inadvertent opening of the belt buckle, the device includes a sleeve adapted to slide along the belt to a position snugly covering the closed buckle and slidably movable away from that position to permit release of the buckle. The sleeve preferably has funnel ends and is formed of a rigid material. A slot in the inner wall of the sleeve permits temporary expansion of the sleeve to accommodate for the increased thickness of the loop of the belt about buckle end connections for the loop followed by a contraction of the sleeve to snugly encase the buckle. A stiff sleeve with releasable fasteners at its ends and with release fasteners between the buckle and sleeve are alternate embodiments.

19 Claims, 3 Drawing Sheets

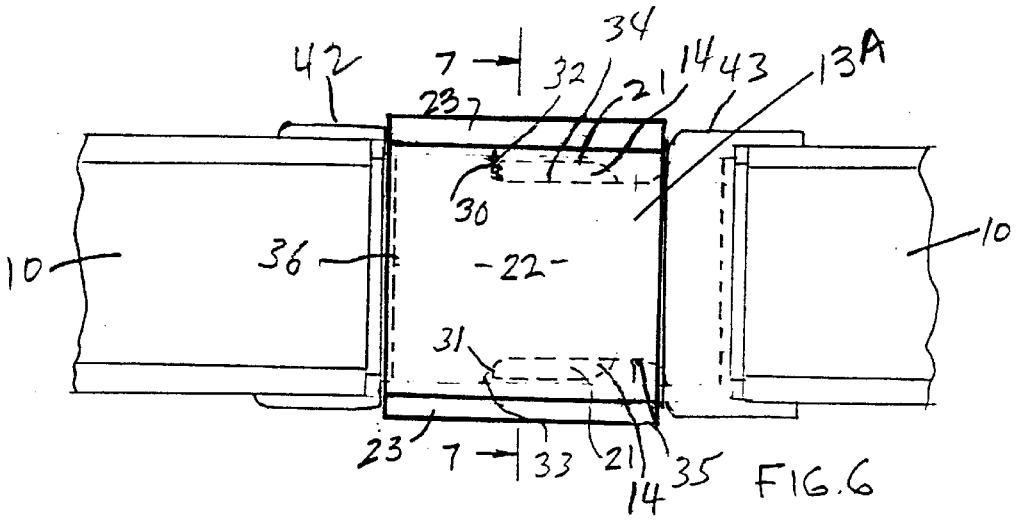
FIG.6
FIG.7
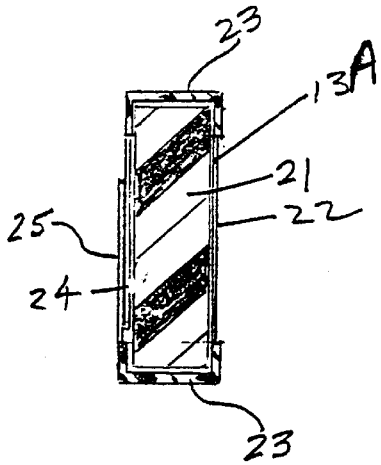
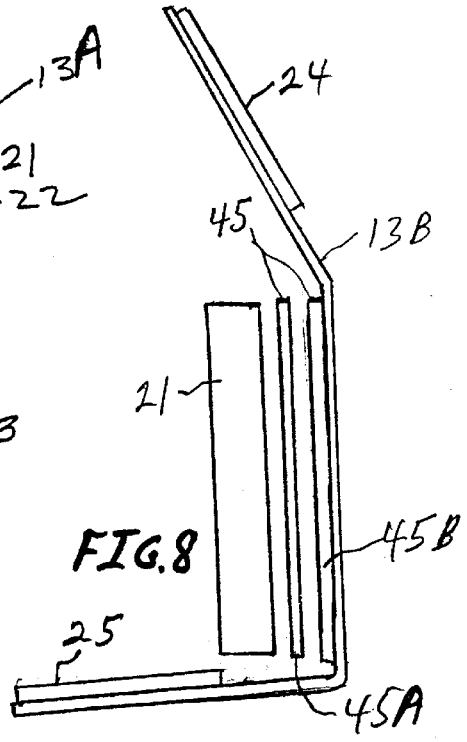
FIG.8

MOVABLE BELT BUCKLE COVER DEVICE AND PROTECTOR

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

A common complaint of law enforcement officers is that in the event of a hand-to-hand struggle with law breakers, it sometimes results in the officer's belt becoming unbuckled with his pistol and other items on the belt falling out of reach, and the law breaker gaining the upper hand by retrieving the officer's belt and weapons. This invention is an effective buckle protector added to the officer's belt to prevent it from becoming accidentally unbuckled.

1. Field of the Invention

This invention relates to the art of police equipment; and more particularly, it relates to an individual waist belt carrying holsters and equipment and having protection against accidental unbuckling.

2. Description of the Related Art

A prior art solution to the unbuckling problem is to provide a central button on the buckle, which must be depressed before unbuckling is permitted. This solution is quite awkward and not easily workable even by the officer when he desires to unbuckle same. Furthermore, this solution is much more costly to implement. This invention alleviates the problems of the prior art in a simple, economical and effective manner.

BRIEF SUMMARY OF THE INVENTION

The present invention is a protective device that guards against the inadvertent unbuckling of the waist belt from which are suspended one or more items that might serve as weapons to be used in disabling the wearer of the belt. This device is especially intended for use by civilian and military police officers. The belt has a front opening buckle of two pieces that fasten together, and a slidable sleeve or buckle cover that can be moved along the belt in a lengthwise direction to cover the buckle snugly and thereby prevent opening of the buckle until the cover is forcibly slid away from the buckle location. This device can be used with any type of buckle where thickness of the buckle portion is not greatly different from the thickness of the buckle portion is not greatly different from the thickness of belt at other locations. This locking arrangement is especially useful with belts where the buckle has a spring-loaded tongue that is insertable into a narrow opening and a wedge-shaped tip prevents withdrawal of the tongue until the tip is sprung aside allowing the tip to pass in the reverse direction through the opening.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 6 is a partial front elevational view of a second embodiment of the buckle cover of this invention;

FIG. 7 is a cross-sectional view taken along line 7—7 of FIG. 6; and FIG. 8 is an elevational exploded view of a third embodiment of this invention.

DETAILED DESCRIPTION OF THE INVENTION

The present invention is an article of wearing apparel used chiefly by law enforcement officers, including police-civilian and military who usually are required to carry weapons and/or implements that are useful in disabling unruly persons that are disturbing the peace or endangering the lives of nearby persons. It is convenient for the police officer to carry these weapons or instruments suspended from a waist belt from which the weapon or instrument can be readily disengaged for use in temporarily disabling the person. Unfortunately, there are times when the police officer may become engaged in pushing, shoving and fighting that sometimes causes the weapon or instrument to become unintentionally detached from the belt. Sometimes the belt buckle is inadvertently opened and everything including the belt is dropped to the ground. The present invention is intended to prevent, or at least to greatly reduce the chances of this occurring. This invention provides an effective cover, be it the sliding cover preferred, or the wrapped cover that can be placed over the buckle on the belt making it virtually impossible to open the buckle until the cover is removed.

Figure 1:
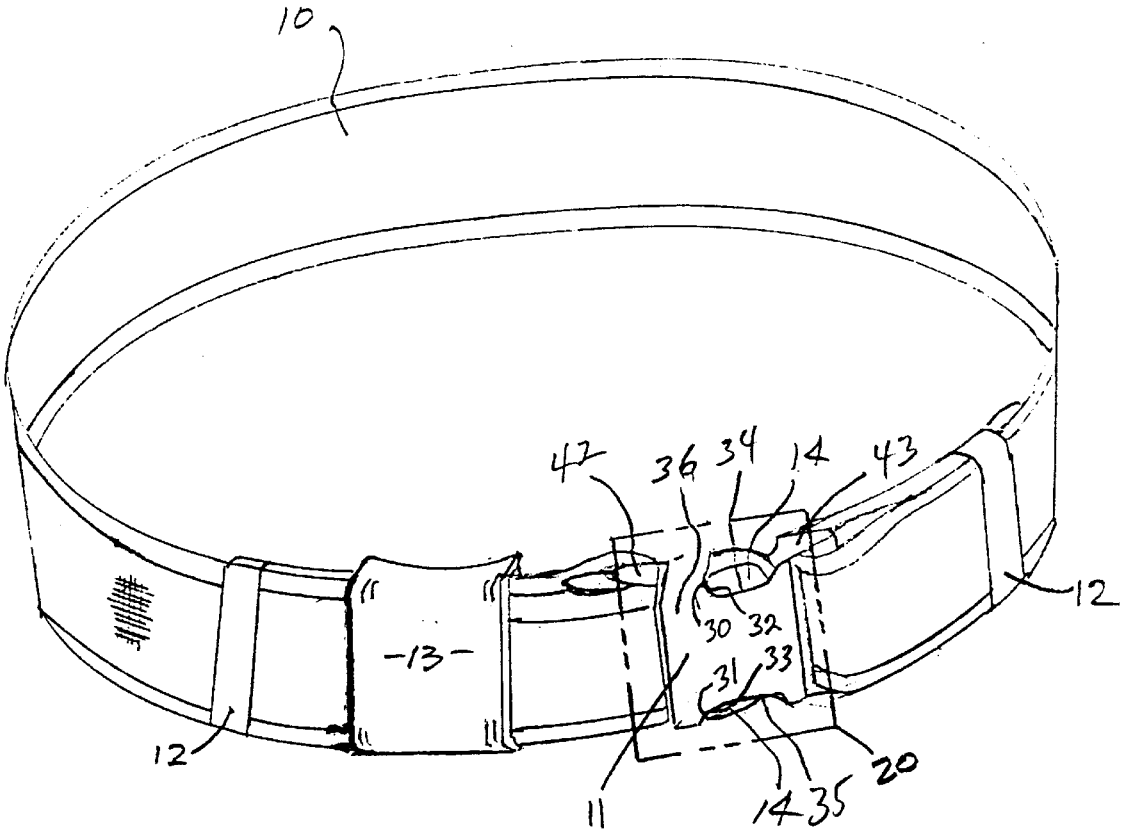
FIG. 1 is a front perspective view of the buckle cover of this invention on a law enforcement belt, the location of the cover in the operative position being shown by broken lines.
Figure 2:
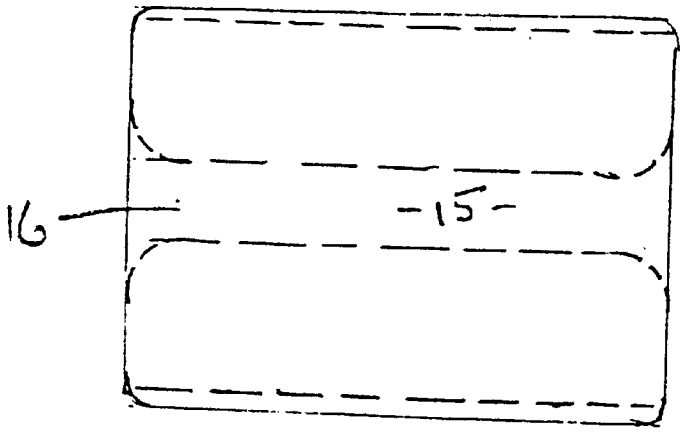
FIG. 2 is a front elevational view of the buckle cover of the present invention.

In FIG. 1 of the attached drawings there is shown a waist belt 10 having a well known buckle 11 designed to be opened at the front, and a sleeve or buckle cover 13 which is slidable along the belt from any position away from the buckle (e.g., as shown in the drawing of FIG. 1) to a position directly over buckle 11, as shown by broken lines at 20 in FIG. 1. This position at 20 effectively prevents the opening of buckle 11 because the buckle 11 can only be opened by squeezing together two opposing prongs 14, which cannot be done until cover 13 is moved right or left to expose or uncover prongs 14. This type of locking and unlocking mechanism is commonly used where two generally parallel and resilient prongs 14 are squeezed together and inserted into an opening or openings in the buckle, the two prongs having shoulders 30, 31 which catch on the edges 32, 33 of the opening or openings 34, 35 in housing 36 when the prongs 14 are released to return to their unsqueezed condition. Other types of locking mechanisms are also able to be secured the cover of this invention.

Figure 5:
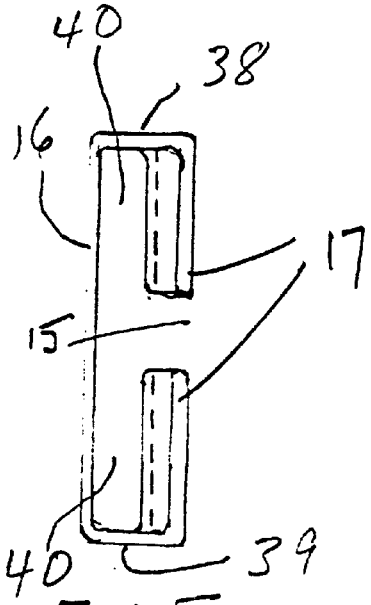
FIG. 5 is an end elevational view of the buckle cover.
Figure 3:
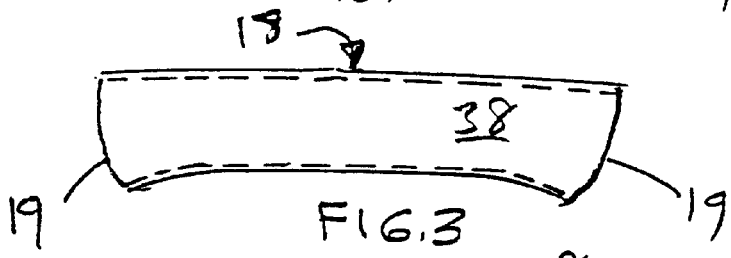
FIG. 3 is a top plan view of the buckle cover.
Figure 4:
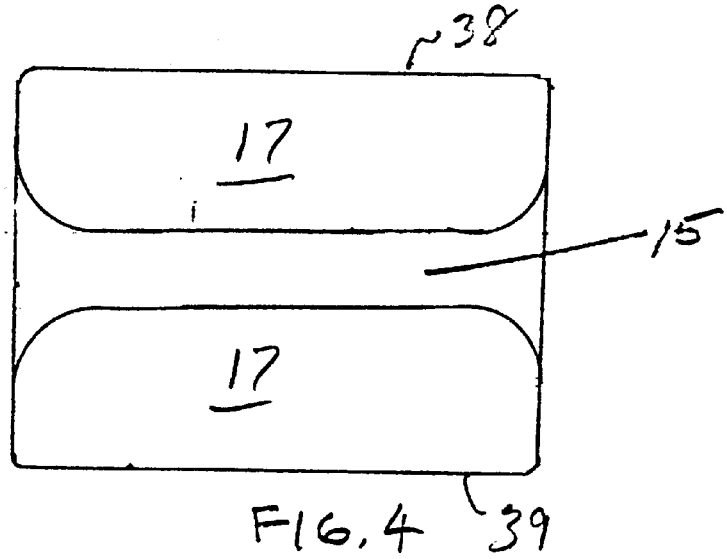
FIG. 4 is a rear elevational view of the buckle cover.

FIGS. 2–5 depict the various features of the sliding cover 13 of this embodiment of the invention. Front wall 16 of cover 13 is shown as a generally flat rectangular surface sufficiently large to extend outwardly over all the edges of buckle 11. The shape of front wall 16 need not be rectangular and may be circular or elliptical, but it should be smooth surfaced so as not to provide any finger gripping edges that might make it easier to slide cover 13 aside. Along the generally horizontal top and bottom edges of wall 16 are flanges 38 and 39 forming the top and bottom walls and then bent at right angles to form a bifurcated back walls 17 with a slot 15 therebetween. As seen in FIG. 5, the cover 13 has a rectangular-shaped tunnel 40 through which belt 10 may be easily threaded to permit cover 13 to be moved lengthwise of the belt 10. It is somewhat critical to make the tunnel 40 generally medially at 18 between the ends 19 (FIG. 3) to fit (substantially) snugly over buckle 11 to make it difficult to move cover 16 over and beyond buckle 11 except with some predetermined amount of force. Cover 13 should be resistant to being slid in either direction once it is centered over buckle 11. Of course, cover 13 must be movable by the wearer so as to put the belt on and take it off; and this may involve some adjustment for the personal desires of each individual wearer. It should be noted that the openings into the tunnel 40 at each end 19 are slightly larger than the thickness of the tunnel 40 at the center 19. This makes it easier to relatively move the cover 13 over the increased thickness of the belt and belt loop attachments 42, 43. The style of cover 13 in having a lengthwise slotted structure at 15 is not critical but it does provide an adjustment feature when considering how tight to make the medial space at 18 for each person wearing the belt 10. Cover 16 may be made of metal, e.g., steel, aluminum, or the like; or of plastic (which is the preferred material of construction) e.g. polyester, polyolefin, polyamide, or the like. It is an important feature of this preferred embodiment that the cover 13 be resiliently deformable so that the top wall 38 and bottom wall 39 and back walls 17 flex to expand the cover 13 while the cover 13 is being moved over either belt and belt loop attachments 42 or 43 and then relaxed to a generally snug fit when the cover 13 is equally centered therebetween.

A second embodiment of this invention is shown in FIGS. 6 and 7 wherein the buckle cover 13A is made of an overlapping stiff fabric closed about the well-known buckle 11 with a suitable releasable fastener, such as "Velcro" fastener of fabric loops and hooks. The same buckle mechanism as shown and described with respect to FIG. 1 is represented in FIGS. 6 and 7 by the box 21. The buckle cover 13A in FIGS. 6 and 7 is a strip of fabric, e.g., canvas, nylon, or the like; fitted with a plurality of stiffened members or other center pieces 23 and portions of fabric loops and fabric hooks 24 and 25 provide a "Velcro" fastener combination to secure the cover 13A around buckle 11. Top and bottom covers 23 preferably are plastic materials cemented or riveted to the basic fabric so as to provide corners that will assist in holding the belt and buckle cover 13' in place overlying and protecting against squeezing manipulation of prongs 14 to unlock the mechanism 21. Cover 13A may be expanded and slid on the belt connector ends if desired or removed and reattached at another location. Cover 13A is more tedious to put on and take off but is effective. Also it has another drawback as to likely being misplaced or lost when needed.

FIG. 8 illustrates a third embodiment by which buckle cover 13B may be somewhat like 13A but includes another Velcro type releasable fastener 45 comprised of loops 45A and hooks 45B, the latter being glued or sewn to the inner side of cover 13B and the former being glued to the buckle represented by box 21. Thus the aforementioned problems of misplacing or losing the cover 13A would be substantially eliminated.

Belt 10 is well known and preferably made of a fabric construction from canvas or a more modern material based on polyamide material, polyester material, polyolefin material, or the like. In order to make the belt 10 less bulky it may include Velcro fabric hooks and loops to attach the buckle 11 to the belt 10, and to provide an adjustment of belt length to fit the different sizes of girth among the persons employing this belt as part of their equipment. Generally this style of belt also includes two keepers 12 to maintain the belt ends tightly attached to the inside surface of the belt. By employing selected types of Velcro releasable fastener materials on the contacting surfaces of the belt near the belt ends the keepers 12 can provide a neat tailored finish to the belt as used.

It is to be understood that an outer elongate flap may be attached at one end to the belt, as by sewing, with such flap overlying any of covers 13, 13A or 13B and the other end tucked in one of the keepers 12. Such a flap would primarily be for providing a fashionable and polished appearance to the entire belt with the attendant disadvantages of costs in materials and fabrication and greater bulk at the front of the belt.

While the invention has been described with respect certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States of America is:

1. A protective device to disable inadvertent opening of a buckle held on by spaced loop attachments to a law enforcement belt adapted to carry holsters and weapons and the like and wherein the buckle includes at least one releasable member to open the buckle, said device comprising a cover adapted and arranged in its operative position to substantially enclose the buckle and to inhibit access to the at least one releasable member without removal of said cover from its said operative position said cover having opposite ends, each said end being funnel-shaped to facilitate the sliding onto and off of said buckle.

2. The device of claim 1 wherein said cover is in the form of a substantially rigid material and being slidable on the belt.

3. The device of claim 1 wherein said cover includes a stiff, elongated fabric removably wrapped around a buckle and releasable fasteners attached to and between overlapping ends of said fabric.

4. The device of claim 3 wherein said cover includes other releasable fasteners connected between said buckle and said fabric generally medially thereof.

5. The device of claim 3 further comprising rigid members carried by said fabric and overlying and inhibiting access to the at least one releasable member.

6. The device of claim 1 wherein said cover is formed with a generally horizontal slot bifurcating a wall adjacent a user said cover being substantially rigid and temporarily deformed by expansion to permit sliding positioning of said cover to its said operative position where it is in its contracted state.

7. The device of claim 1 wherein the belt and spaced loop attachments of the buckle are larger than the releasable buckle, said ends of said cover readily funnel in the belt and loop attachments to assist seating of said cover between the spaced loop attachments.

8. The device of claim 7 wherein said cover is formed with a generally horizontal slot bifurcating a wall adjacent a user.

9. The device of claim 8 wherein said cover inhibits access to the at least one releasable member and to another releasable member located generally in the same plane but opposite thereto.

10. A protective device to disable an inadvertent attempt to open a buckle of a law enforcement belt adapted to carry holsters for handguns and the like wherein the buckle includes at least one releasable fastener operative to open the buckle, said device comprising a selectively slidable sleeve of a substantially rigid material attached about the belt and slidable to a protective position overlying the buckle to inhibit unlocking of the belt, and slidable to either side of the buckle to an unprotective position to allow unlocking of the belt without removal from the belt.

11. The device of claim 10 wherein said slidable sleeve presses against said belt where it overlies the buckle producing sufficient friction to require a forcible movement to permit the sleeve to pass over the buckle but allowing said sleeve to be moved freely without noticeable friction at other locations of said belt away from the buckle.

12. The device of claim 11 wherein said slidable sleeve is formed of a stiff fabric located over the top and bottom of the buckle to inhibit access to the at least one releasable fastener, said fabric having a releasable fastener to wrap said fabric fittedly and tightly around the buckle.

13. In combination a protective device to disable inadvertent opening of a buckle of a law enforcement belt adapted to carry holsters for handguns and the like, comprising an elongated belt and a buckle including at least one releasable fastener operative to open said buckle, said device including a selectively slidable sleeve of substantially rigid material attached about said belt and slidable to a protective position substantially overlying said buckle to inhibit unlocking of said buckle, said sleeve being forcibly slid from its protective position to unprotective positions adjacent said buckle on either side of said buckle while remaining on and carried by said belt.

14. The combination of claim 13 wherein said sleeve includes a generally horizontal slot bifurcating an inside wall of said sleeve inwardly of said belt adjacent a user of said belt.

15. The combination of claim 14 wherein said slot permits temporary expansion of said sleeve to provide forcible sliding of said sleeve to its said protective position followed by contraction to a normal state of said sleeve.

16. The combination of claim 13 wherein said sleeve includes opposite end portions, at least one said end portion being generally funnel shaped to permit ready ingress of said sleeve on said belt into said protective position.

17. The combination of claim 13 wherein said belt adjacent each side of said buckle is thicker than said belt or its attachment to said buckle, said sleeve having opposite end portions each being funnel shaped to permit ready ingress of said sleeve over either side of said buckle on said belt into said protective position.

18. The combination of claim 13 wherein said buckle includes a pair of loop attachment ends with ends of said belt looping therethrough, said belt ends looping and attachment ends being thicker in dimension than releasable attaching portions of said buckle, said sleeve having opposite end portions each being funnel shaped to receive said thicker dimension to permit ready positioning of said sleeve over either of said loop attachment ends.

19. The combination of claim 18 wherein said sleeve includes a generally horizontal slot bifurcating an inside wall thereof adjacent a user of said belt.

* * * * *